US008464698B2

(12) United States Patent
Durkin et al.

(10) Patent No.: US 8,464,698 B2
(45) Date of Patent: Jun. 18, 2013

(54) AIR INTAKE ASSEMBLY WITH INTEGRATED CRANKCASE VENTILATION SYSTEM

(75) Inventors: Thomas Richard Durkin, Oxford, MI (US); Alan E. Rice, New Baltimore, MI (US)

(73) Assignee: GM Global Technology Operations LLC

( * ) Notice: Subject to any disclaimer, the term of this patent is extended or adjusted under 35 U.S.C. 154(b) by 1455 days.

(21) Appl. No.: 12/109,095

(22) Filed: Apr. 24, 2008

(65) Prior Publication Data

US 2009/0266326 A1 Oct. 29, 2009

(51) Int. Cl.
*F02B 25/06* (2006.01)

(52) U.S. Cl.
USPC ..... 123/573; 123/90.38; 123/184.21; 123/196 R

(58) Field of Classification Search
USPC ..... 123/572–574, 317, 184.39, 433, 123/41.86, 196 AB, 195 R, 1 R, 198 P, 327, 123/198 E, 90.38, 184.21, 196 R; 55/355, 55/417
See application file for complete search history.

(56) References Cited

U.S. PATENT DOCUMENTS

| | | | | |
|---|---|---|---|---|
| 6,293,268 | B1 * | 9/2001 | Mammarella | 123/574 |
| 6,390,080 | B1 * | 5/2002 | Dowding et al. | 123/572 |
| 7,509,950 | B2 | 3/2009 | Dieterle et al. | |
| 2011/0036321 | A1 * | 2/2011 | Lewis et al. | 123/184.22 |

FOREIGN PATENT DOCUMENTS

JP 2006220149 A * 8/2006

* cited by examiner

*Primary Examiner* — Noah Kamen
(74) *Attorney, Agent, or Firm* — Harness, Dickey & Pierce, P.L.C.

(57) ABSTRACT

An engine assembly may include an engine block, a first cylinder head, and an air intake assembly. The engine block may include a first bank defining a first set of cylinders. The first cylinder head may be fixed to the first bank and may include a first set of intake ports. The air intake assembly may include an intake air tube, a crankcase ventilation housing integrally formed with the intake air tube, and an oil separation assembly located within the crankcase ventilation housing. The intake air tube may be in communication with the first set of intake ports and an air source. The crankcase ventilation housing may have a wall at least partially defined by the intake air tube.

18 Claims, 4 Drawing Sheets

AIR INTAKE ASSEMBLY WITH INTEGRATED CRANKCASE VENTILATION SYSTEM

FIELD

The present disclosure relates to engine assemblies, and more specifically to air intake configurations for engine assemblies.

BACKGROUND

The statements in this section merely provide background information related to the present disclosure and may not constitute prior art.

Engine assemblies may include an air intake system and a crankcase ventilation system. The air intake system may include a conduit to provide air to an intake manifold that is independently formed from the crankcase ventilation system. As a result, the conduit may need to be routed around the crankcase ventilation system, resulting in packaging and design constraints for the air intake system and the crankcase ventilation system.

SUMMARY

An engine assembly may include an engine block, a first cylinder head, and an air intake assembly. The engine block may include a first bank defining a first set of cylinders. The first cylinder head may be fixed to the first bank and may include a first set of intake ports. The air intake assembly may include an intake air tube, a crankcase ventilation housing integrally formed with the intake air tube, and an oil separation assembly located within the crankcase ventilation housing. The intake air tube may be in communication with the first set of intake ports and an air source. The crankcase ventilation housing may have a wall at least partially defined by the intake air tube.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
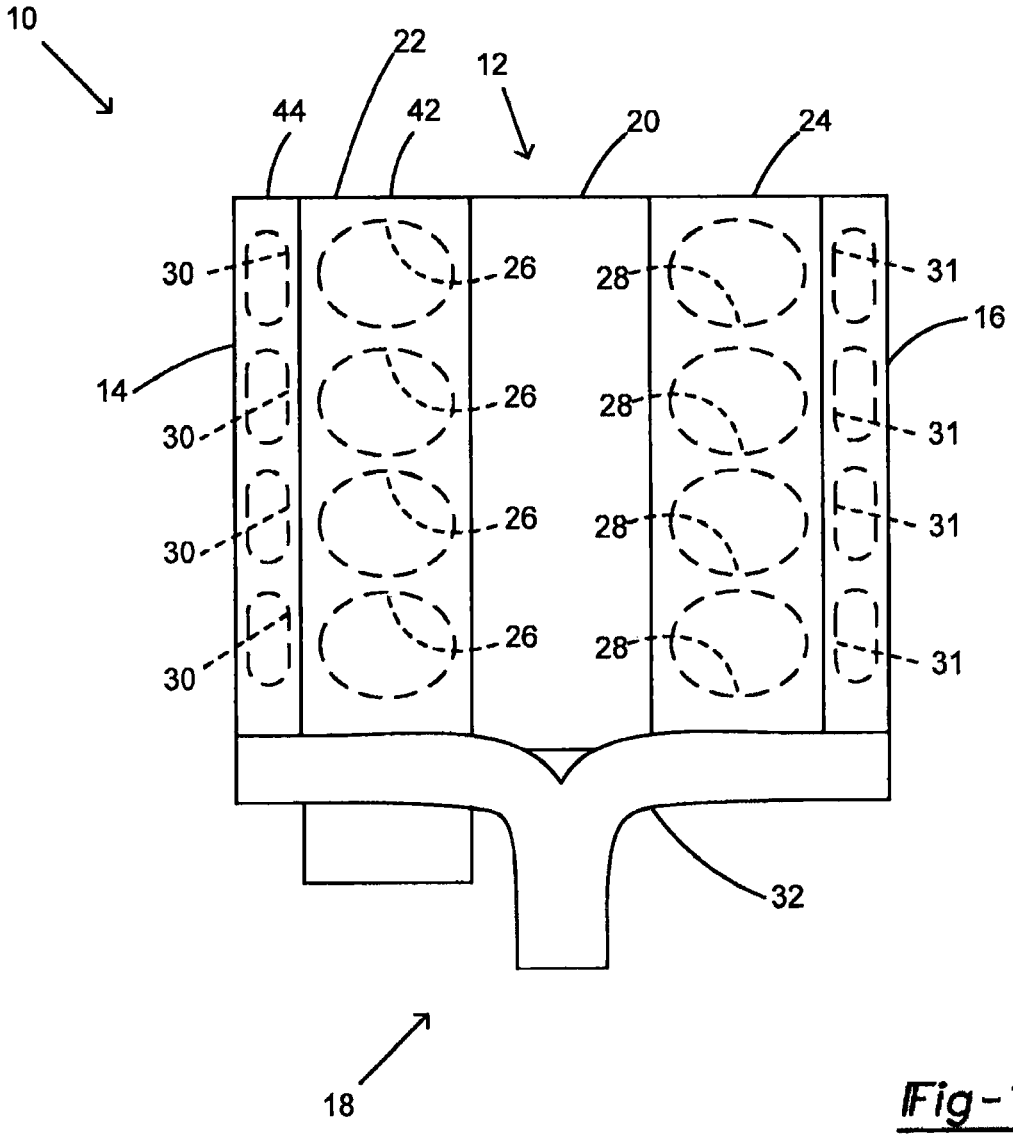
FIG. 1 is a schematic illustration of an engine assembly according to the present disclosure.

The following description is merely exemplary in nature and is not intended to limit the present disclosure, application, or uses. It should be understood that throughout the drawings, corresponding reference numerals indicate like or corresponding parts and features.

Referring now to FIG. 1, an exemplary engine assembly 10 is schematically illustrated. The engine assembly 10 may include an engine 12, first and second cover members 14, 16, and an air intake assembly 18. The engine 12 may include an engine block 20 having a V-configuration with first and second cylinder heads 22, 24. The engine block 20 may include first and second cylinder banks that define first and second sets of cylinders 26, 28 disposed at an angle relative to one another to form the V-configuration. However, while described in terms of a V-configuration engine in the present example, it is understood that the present teachings apply equally to a variety of other engine configurations as well, such as inline engines. The first cylinder head 22 may include intake air ports 30 and the second cylinder head 24 may include intake air ports 31. With additional reference to FIGS. 2 and 3, the air intake assembly 18 may include an intake air tube 32, a crankcase ventilation assembly 34, an oil fill housing 36, and a cap member 38.

The first cover member 14 may include a first portion that forms a cam cover portion 42 and a second portion that forms an intake manifold portion 44 to form an integrated cam cover/intake manifold. The second cover member 16 may form an integrated cam cover/intake manifold similar to the first cover member 14, and therefore will not be described in detail with the understanding that the above description equally applies to the second cover member 16.

The first cover member 14 may additionally include an intake assembly mounting region 46 (seen in FIG. 3) defining a first opening 48 in communication with the cam cover portion 42 and a second opening 50 in communication with the intake manifold portion 44. The first opening 48 may form an outlet for crankcase gases from the cam cover portion 42 as well as an oil return passage. The second opening 50 may form an inlet for air from the inlet air tube 32 of the air intake assembly 18 to the intake manifold portion 44. The intake assembly mounting region 46 may include a generally planar surface 52 having a generally continuous channel 54 for receiving a sealing gasket 56. The intake assembly mounting region 46 may further include a series of apertures 58 for receiving fasteners 60 to directly couple the air intake assembly 18 to the first cover member 14.

Figure 2:
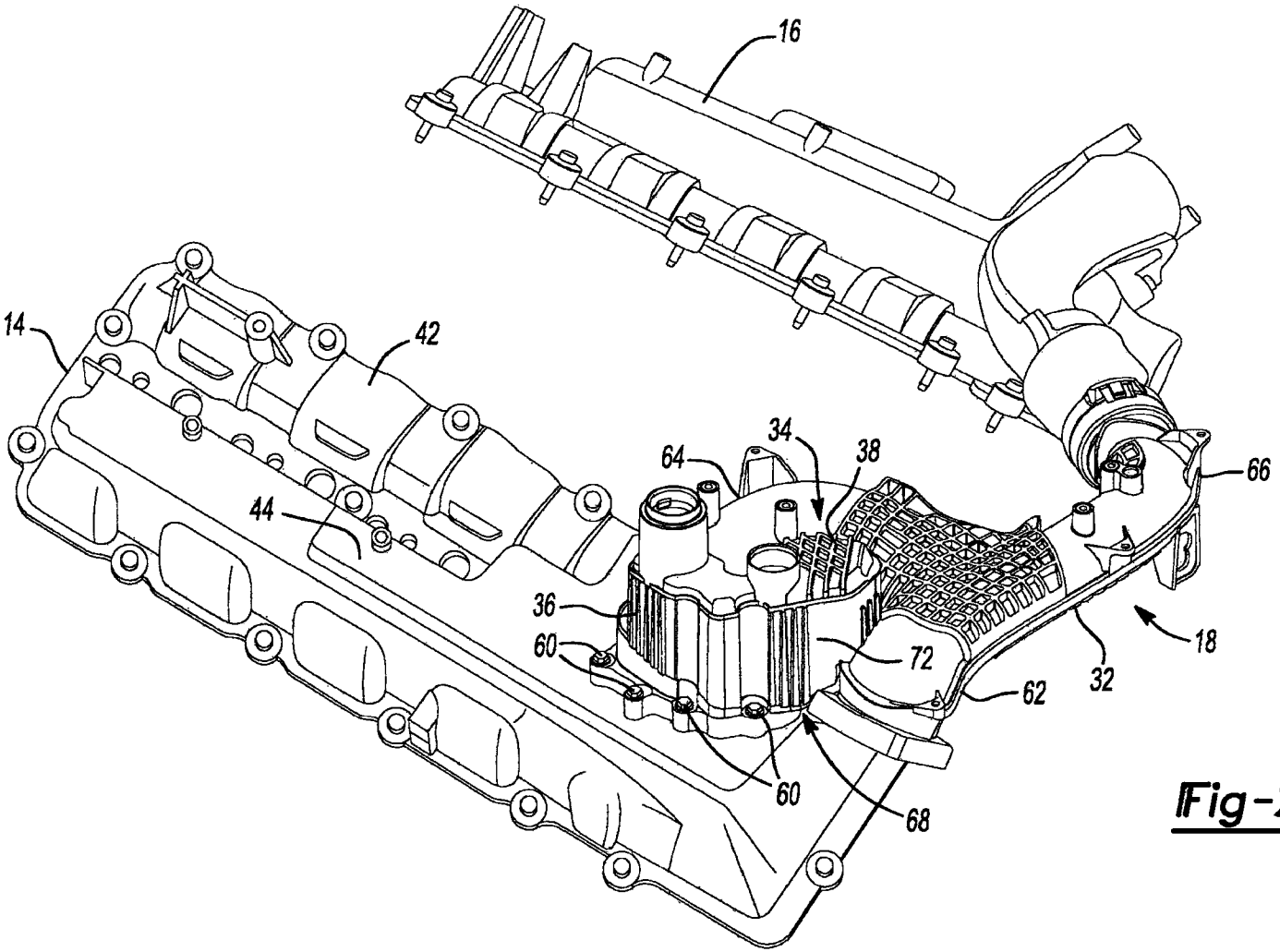
FIG. 2 is a perspective view of an air intake assembly of the engine assembly of FIG. 1.
Figure 3:
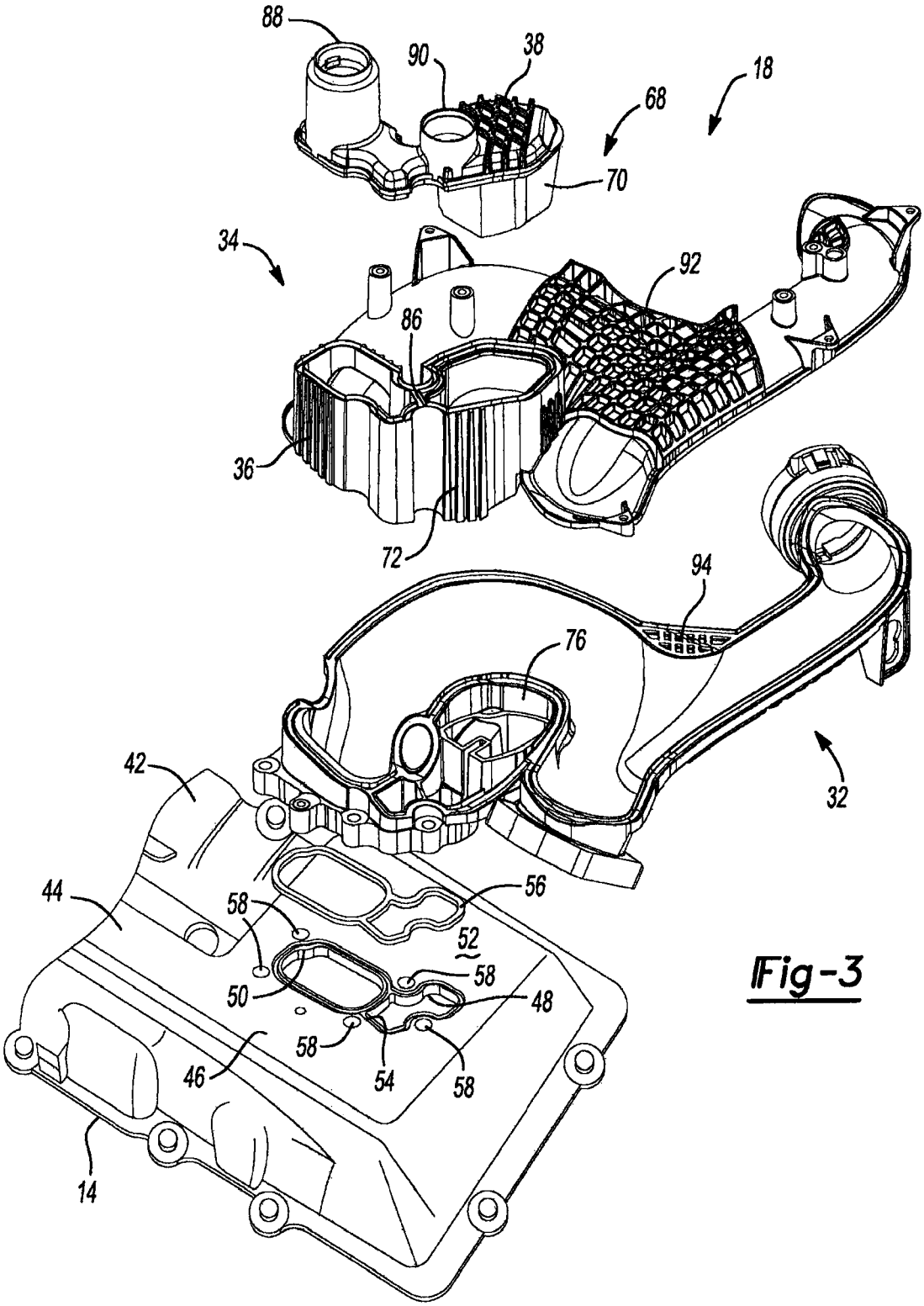
FIG. 3 is a fragmentary perspective exploded view of the air intake assembly of FIG. 2.
Figure 4:
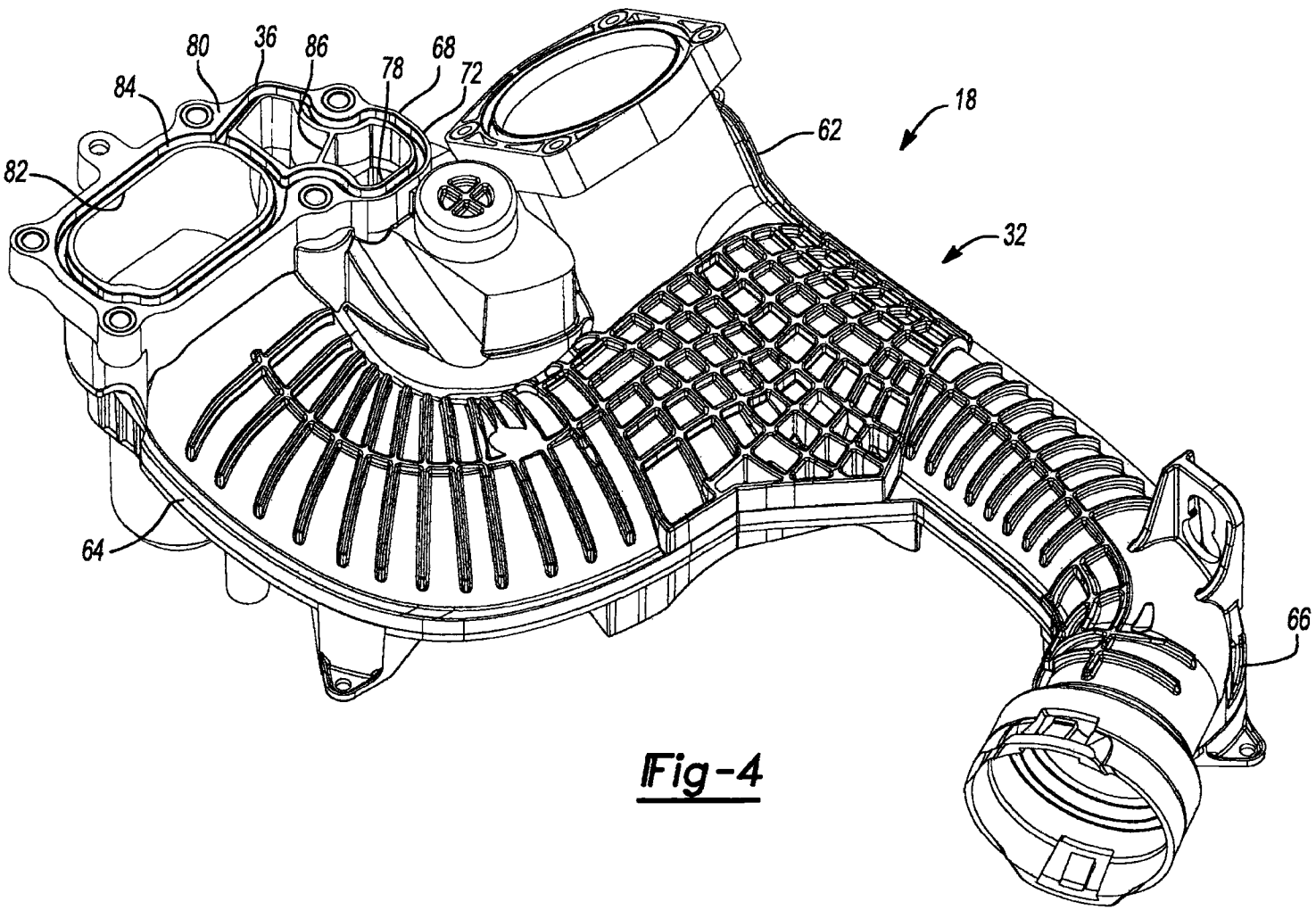
FIG. 4 is an additional perspective view of the air intake assembly of FIG. 3.

With reference to FIGS. 2-4, the intake air tube 32 may include an inlet branch 62 in communication with an air source, a first outlet branch 64 in communication with the first cover member 14 and the inlet branch 62, a second outlet branch 66 in communication with the second cover member 16 and the inlet branch 62. The crankcase ventilation assembly 34 may include a crankcase ventilation housing assembly 68 and an oil separation assembly 70. The crankcase ventilation housing assembly 68 may include a ventilation housing 72 integral with the intake air tube 32. The oil separation assembly 70 may be located within the ventilation housing 72.

The ventilation housing 72 may include a wall 76 at least partially defined by the intake air tube 32. For example, the wall 76 may be a common shared wall for the ventilation housing 72 and the first outlet branch 64 of the intake air tube 32. Therefore, the wall 76 may be in thermal communication with the vent housing 72 and the intake air tube 32 and during engine operation air flow through the intake air tube 32 may transfer heat to the ventilation housing 72, reducing the likelihood of freezing in the oil separation assembly 70. The integration of the ventilation housing 72 with the intake air tube 32 may additionally reduce package size of the air intake assembly 18.

The ventilation housing 72 may further include an air inlet 78 at a lower portion thereof. The air inlet 78 may extend through an end surface 80 of the air intake assembly 18. The outlet 82 of the first outlet branch 64 may additionally extend through the end surface 80 of the air intake assembly 18. The wall 76 may extend to the end surface 80.

The oil fill housing 36 may be located adjacent the ventilation housing 72 and may extend through the end surface 80 of the air intake assembly 18 as well. The oil fill housing 36 may be integral to the ventilation housing 72 and may be separated from the inside of the ventilation housing 72 by a wall 86.

A generally continuous channel 84 may extend into the end surface 80 and receive the sealing gasket 56 therein, isolating the intake air flow path from the crankcase ventilation flow path. The end surface 80 may define a generally planar sealing surface for the air intake assembly 18.

The cap member 38 may be fixed to an upper portion of the ventilation housing 72 and the oil fill housing 36. The cap member 38 may include an oil fill inlet 88 and a crankcase ventilation system outlet 90. The crankcase ventilation system outlet 90 may be placed in communication with the intake air tube 32 in variety of ways to recirculate the crankcase gases. For example, an additional hose (not shown) may be provided to couple the crankcase ventilation system outlet 90 to the intake air tube 32 and provide direct communication between the crankcase ventilation system outlet 90 and the intake air tube 32. Alternatively, the crankcase ventilation system outlet 90 may be in communication with an additional component, such as a turbocharger (not shown), that is in communication with the intake air tube 32.

While the first and second covers members 14, 16 may generally form intake manifolds in the present example, it is understood that the present teachings may be incorporated into engines including inboard intake manifolds as well. Further, it is understood that while the crankcase ventilation assembly 34 is shown in communication with the first cover member 14 in the present example, the present teachings are not limited to this configuration. The crankcase ventilation assembly 34 may be in communication with a variety of engine locations that are in communication with the engine crankcase. For example, the crankcase ventilation assembly 34 may be in communication with an engine front cover, an engine rear cover, or a cylinder head.

As seen in FIG. 3, the intake air tube 32, the ventilation housing 72, and the oil fill housing 36 may be formed as first and second parts 92, 94. The first and second parts 92, 94 may each form a portion of each of the intake air tube 32, the ventilation housing 72, and the oil fill housing 36 and may be welded to one another. Each of the first and second parts 92, 94 may be formed as a molded polymer component or as a metal casting. For example, the first and second parts may each be formed from an aluminum casting. The first and second parts 92, 94 may be fixed to one another before being coupled to the engine 12. Alternatively, the first and second parts 92, 94 may be formed as a single component. For example, a single casting may be used to form both the first and second parts 92, 94.

What is claimed is:

1. An engine air intake assembly comprising:

an intake air tube adapted to provide communication between an engine intake manifold and an air source;

a crankcase ventilation housing integrally formed with the intake air tube, the crankcase ventilation housing having a wall at least partially defined by the intake air tube, the wall being in thermal communication with the intake air tube and the crankcase ventilation housing to transfer heat from an air flow through the intake air tube to the crankcase ventilation housing; and an oil separation assembly located within the crankcase ventilation housing adapted to remove oil from air passing through the crankcase ventilation housing.

2. The engine air intake assembly of claim 1, further comprising an oil fill housing integrally formed with the crankcase ventilation housing, the oil fill housing defining an oil passage isolated from an interior of the crankcase ventilation housing.

3. The engine air intake assembly of claim 1, wherein the crankcase ventilation housing includes an air inlet adapted to be directly fastened to and abut an engine valve cover.

4. The engine air intake assembly of claim 3, wherein the intake air tube includes an air outlet portion defining an outlet from the intake air tube, the wall separating the air inlet of the crankcase ventilation housing from the air outlet portion of the intake air tube.

5. The engine air intake assembly of claim 4, wherein the air inlet of the crankcase ventilation housing and the air outlet portion of the intake air tube define a generally planar end surface having a generally continuous sealing channel adapted to receive a sealing gasket therein.

6. The engine air intake assembly of claim 1, wherein the intake air tube includes a first branch, a second branch, and an inlet branch in communication with the air source and the first and second branches, the first branch at least partially defining the wall of the crankcase ventilation housing and adapted to provide communication between a first intake manifold associated with a first set of cylinders and the inlet branch and the second branch adapted to provide communication between a second intake manifold associated with a second set of cylinders and the inlet branch.

7. An engine assembly comprising:

an engine block including a first bank defining a first set of cylinders;

a first cylinder head fixed to the first bank and including a first set of intake ports; and an air intake assembly including:

an intake air tube in communication with the first set of intake ports and an air source;

a crankcase ventilation housing integrally formed with the intake air tube and having a wall at least partially defined by the intake air tube, the wall being in thermal communication with the intake air tube and the crankcase ventilation housing to transfer heat from an air flow through the intake air tube to the crankcase ventilation housing; and an oil separation assembly located within the crankcase ventilation housing and adapted to remove oil from air passing through the crankcase ventilation housing.

8. The engine assembly of claim 7, wherein the air intake assembly includes an oil fill housing integrally formed with the crankcase ventilation housing, the oil fill housing defining an oil passage isolated from an interior of the crankcase ventilation housing.

9. The engine assembly of claim 7, further comprising a first cover member fixed to the first cylinder head and including a cam cover portion, the oil separation assembly being in communication with the cam cover portion of the first cover member.

10. The engine assembly of claim 9, wherein the crankcase ventilation housing includes an air inlet directly fastened to and abutting the first cover member.

11. The engine assembly of claim 10, wherein the intake air tube includes an air outlet portion defining an outlet from the intake air tube, the wall separating the air inlet of the crankcase ventilation housing from the air outlet portion of the intake air tube.

12. The engine assembly of claim 11, wherein the air inlet of the crankcase ventilation housing and the air outlet portion of the intake air tube define a generally planar end surface having a generally continuous sealing channel adapted to receive a sealing gasket therein.

13. The engine assembly of claim 9, further comprising a second cylinder head including a second set of intake ports and a second cover member fixed to the second cylinder head, the engine block including a second bank defining a second set of cylinders and the second cylinder head being fixed to the second bank, the first cover member including a first intake manifold portion in communication with the first set of intake ports and the second cover member including a second intake manifold portion in communication with the second set of intake ports, the intake air tube including a first branch coupled to the first intake manifold portion, a second branch coupled to the second intake manifold portion, and an inlet branch in communication with the air source and the first and second branches, the first branch at least partially defining the wall of the crankcase ventilation housing.

14. The engine assembly of claim 13, wherein the first set of cylinders is disposed at an angle relative to the second set of cylinders to form a V-configuration.

15. The engine assembly of claim 9, wherein the first cover member includes a first intake manifold portion in communication with the first set of intake ports, the intake air tube including a first branch coupled to the first intake manifold portion and an inlet branch in communication with the air source and the first branch, the first branch at least partially defining the wall of the crankcase ventilation housing.

16. An engine assembly comprising:

an engine block including a first bank defining a first set of cylinders;

a first cylinder head fixed to the first bank and including a first set of intake ports;

a first cover member fixed to the first cylinder head and defining a cam cover portion and an intake manifold portion, the cam cover portion being in communication with engine crankcase gases and the intake manifold portion being in communication with the first set of intake ports; and an air intake assembly including:

an intake air tube in communication with the intake manifold portion of the first cover member and an air source;

a crankcase ventilation housing integrally formed with the intake air tube and having a wall at least partially defined by the intake air tube, the wall being in thermal communication with the intake air tube and the crankcase ventilation housing to transfer heat from an air flow through the intake air tube to the crankcase ventilation housing; and an oil separation assembly located within the crankcase ventilation housing and adapted to remove oil from air passing through the crankcase ventilation housing.

17. The engine assembly of claim 16, wherein the first cover member defines a first opening in communication with the cam cover portion that forms an outlet for the crankcase gases to the oil separation assembly and defines a second opening in communication with the intake manifold portion that forms an inlet for air from the intake air tube.

18. The engine assembly of claim 17, wherein the first cover member includes a generally planar surface defining the first and second openings and forming a mounting surface coupling the air intake assembly to the first cover member.

* * * * *